United States Patent [19]

Lejdegard

[11] 3,943,986

[45] Mar. 16, 1976

[54] SCREW DRIVER BIT

[75] Inventor: Sixten Harald Lejdegard, Ramnas, Sweden

[73] Assignee: Bulten-Kanthal AB Hallstahammar, Sweden

[22] Filed: Mar. 4, 1975

[21] Appl. No.: 555,196

[30] Foreign Application Priority Data

Mar. 4, 1974 Sweden ..... 7402839

[52] U.S. Cl. ..... 145/50 B; 145/50 R; 145/116 R; 408/226

[51] Int. Cl.[2] ..... B25B 15/00

[58] Field of Search ..... 145/50 B, 50 R, 116 R; 408/226, 239

[56] References Cited

UNITED STATES PATENTS

| | | | |
|---|---|---|---|
| 118,178 | 8/1871 | Arnold | 408/226 |
| 1,043,098 | 11/1912 | Gross | 408/226 X |
| 2,071,050 | 2/1937 | Underwood et al. | 145/50 R |
| 2,527,492 | 10/1950 | Cleary et al. | 145/50 B |

*Primary Examiner*—Al Lawrence Smith
*Assistant Examiner*—J. T. Zatarga
*Attorney, Agent, or Firm*—Hill, Gross, Simpson, Van Santen, Steadman, Chiara & Simpson

[57] ABSTRACT

A screw driver bit for use with power screw drivers having at the mounting end thereof three equiangularly spaced axial recesses which form three equiangularly spaced drive surfaces for engagement by mating surfaces within a drive socket in the power screw driver.

3 Claims, 4 Drawing Figures

SCREW DRIVER BIT

FIELD OF THE INVENTION

This invention relates to a screw driver bit for use with power screw drivers, International Class B25 b 15/00.

BACKGROUND OF THE INVENTION

Presently, screw driver bits for use with power screw drivers are normally designed with a hexagonal rear end to permit an easily removable insertion into a mating internally hexagonal drive socket in the power screw driver. It may then sometimes happen that the screw driver bit after extensive use may become jammed within the drive socket under a wedging action due to a deformation by swaging.

In connection with nut tightening apparatuses of the impact type it has been proposed to design the drive mechanism in such a manner that the blows hit the rotary socket pin simultaneously on both sides thereof.

The U.S. Pat. No. 2,564,356, to A. E. Dianda, discloses a screw driver the handle of which comprises two parts. The foremost part is rigidly secured to the screw driver bit, whereas the rearmost part is rotatable with respect to the foremost part and is connected to the bit stem by means of a latch coupling. The latch coupling comprises a plurality of latch teeth at the rear end of the bit stem and a spring biased lath in the rearmost handle portion for engagement with said latch teeth. Such an arrangement may be entirely satisfying for a mannual screw driver but is far too weak for a power screw driver.

SUMMARY OF THE INVENTION

One object of the invention is to provide a screw driver bit for power screw drivers which is designed in such a manner that a well balanced driving torque transmission to the screw driver bit is ensured, at the same time as all risks for jamming by swaging are eliminated.

Accordingly, the invention provides a screw driver bit for power screw drivers comprising a foremost drive tip for engagement with the drive recess of the screws and a rear mounting end for removable attachment of the screw driver bit to a drive socket of the power screw driver, wherein the mounting end has three circumferentially symmetrically spaced axial recesses which in cross-sections perpendicular to the screw driver bit axis have the shape of half crescents in that they each at one edge merge with the circular cylindrical outer surface of the screw driver bit whereas they at the opposite edge are defined by a flat surface facing opposite the screw tightening direction and disposed in a radial plane with respect to the axis of the screw driver bit.

IN THE DRAWING

DESCRIPTION OF A PREFERRED EMBODIMENT

Figure 4:
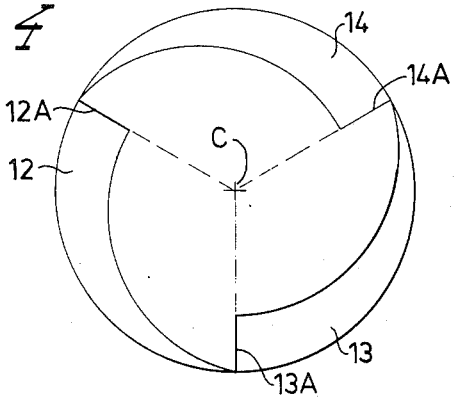
FIG. 4 is an end-view of the screw driver in FIG. 1 in a further enlarged scale.

The rear end 10A of the screw driver bit, generally denoted 10, has three circumferentially evenly spaced recesses 12,13 and 14, each having a cross-section resembling half a crescent. At one edge the recesses 12,13 and 14 merge with the cylindrical outer surface of the bit stem, whereas they, at the other edge, are defined by a flat drive surface 12A,13A and 14A, respectively, which runs axially of the stem and is disposed in a truly radial plane relative to the central axis of the screw driver bit, denoted C in FIG. 4. Of course, the drive surfaces 12A,13A and 14A face opposite the screw tightening direction.

In a typical case, the diameter of the screw driver bit stem is 5.6 millimeters, and the drive surfaces have each a width of 1.2 millimeter. The axial length of the recesses is of the order of 15 millimeters.

In the embodiment shown, the screw driver bit has, at the rear end thereof, a circumferential groove 15 to accomodate a spring washer or the like to lock the screw driver bit against axial movements within the power screw driver. In the embodiment as shown the groove 15 is disposed within the area of the recesses, but the groove might also be disposed slightly closer to the drive tip so that the recesses would be left uninterrupted.

Figure 1:
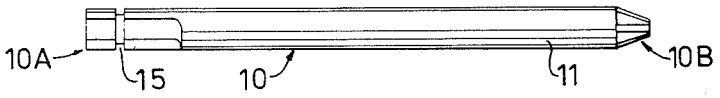
FIG. 1 is a side view of a screw driver bit according to the invention.
Figure 2:
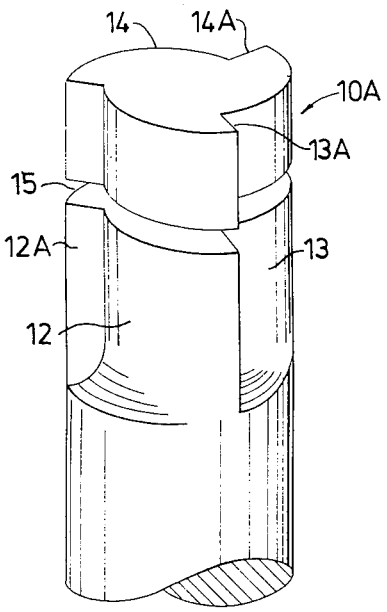
FIG. 2 shows the rear end of the screw driver bit in FIG. 1 to an enlarged scale.
Figure 3:
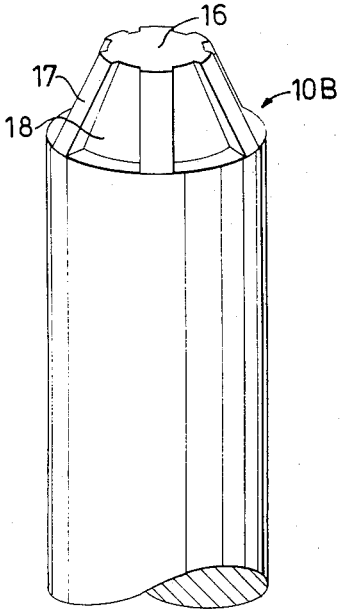
FIG. 3 shows the foremost end of the screw driver in FIG. 1 to an enlarged scale.

The above described design of the rear end 10A of the screw driver bit brings about a plurality of advantages with respect to both the function and the manufacture, irrespective of the design of the drive tip 10B, but some special advantages are gained with a screw driver bit the drive tip of which is designed in the manner as indicated in FIG. 3. To wit, to afford a complete advantage of a drive bit design as shown on engagement with a correspondingly designed screw drive recess a very accurate guiding of the screw driver bit and a circumferentially symmetrical driving thereof will be required.

Screws for use of such a screw driver bit are disclosed in my co-pending U.S. patent application Ser. No. 498,469, filed on Aug. 14, 1974, to which reference is hereby made.

As shown in FIG. 3 the screw driver according to the invention has the drive tip 10B thereof designed as a frusto cone 16, the surface of which is formed by ridges 17 alternating with grooves 18, to mate with the drive recesses of screws of the type referred to. Thereby, the ridges appears as being straight whereas the grooves 18 appears as being triangular. Of course, the exact geometry of the drive tip 10B is adapted to that of the drive recesses of the screws.

Modifications and alterations as to details may be carried out within the scope of the appended claims.

What I claim is:

1. A screw driver bit for use with power screw drivers, comprising a foremost drive tip for engagement with the drive recess of the screws and a rear mounting end for removable attachment of the screw driver bit to a drive socket of the power screw driver, wherein the mounting end has three circumferentially symmetrically spaced axial recesses which in crosssections perpendicular to the screw driver bit axis have the shape of half crescents in that they each at one edge merge with the circular cylindrical outer surface of the screw driver bit whereas they at the opposite edge are defined by a flat surface facing opposite the screw tightening direction and disposed in a radial plane with respect to the axis of the screw driver bit.

2. A screw driver bit as claimed in claim 1, wherein said flat surfaces have a width of 15–25 percent, preferably about 20 percent of the outer diameter of the screw driver bit.

3. A screw driver bit as claimed in claim 1, wherein the axial length of the recesses is of the order of about twice the outer diameter of the screw driver bit.

* * * * *